US006857595B1

(12) United States Patent
Schaefer

(10) Patent No.: US 6,857,595 B1
(45) Date of Patent: Feb. 22, 2005

(54) RECYCLABLE MOTION PICTURE REEL WITH INTERNAL LATCH

(76) Inventor: Robert J. Schaefer, 2800 Keller Dr., Suite 70, Tustin, CA (US) 92782-1007

( * ) Notice: Subject to any disclaimer, the term of this patent is extended or adjusted under 35 U.S.C. 154(b) by 0 days.

(21) Appl. No.: 10/647,187

(22) Filed: Aug. 25, 2003

(51) Int. Cl.[7] ..... B65H 75/14
(52) U.S. Cl. ..... 242/608.5; 242/609.3
(58) Field of Search ..... 242/608.5, 609.3, 242/118.61

(56) References Cited

U.S. PATENT DOCUMENTS 5,114,089 A 5/1992 Posso
5,676,332 A 10/1997 Kraus et al.
5,775,634 A 7/1998 Fettes et al.

*Primary Examiner*—John Q. Nguyen
(74) *Attorney, Agent, or Firm*—Charles H. Thomas

(57) ABSTRACT

A motion picture reel is comprised of separable components including a hub formed with a hollow central, cylindrical sleeve and a pair of side retainers on opposing sides of the hub that hold the film therebetween. Each of the side retainers is provided with a central core located on its inner surface. Each core has a generally cylindrical configuration. A prong is formed to project longitudinally from each core parallel to and at a spaced distance from the axis of rotation. A corresponding prong receiving socket is defined in the core diametrically opposite the prong. The cores of the side retainers are inserted into the central, tubular sleeve of the hub so that the prong of each core enters the prong receiving socket or cavity of the other core. A slight counterrotation of the side retainers relative to each other latches the hooks on the ends of the prongs into the sockets. Releaseable hub latching fingers on each of the retainers engage the side retainers with the hub as the hooks of the prongs are engaged in the sockets.

14 Claims, 9 Drawing Sheets

RECYCLABLE MOTION PICTURE REEL WITH INTERNAL LATCH

BACKGROUND OF THE INVENTION

1. Field of the Invention

The present invention relates to motion picture reels upon which motion picture film is wound and unwound as the film is passed through a motion picture projector for presentation of a motion picture to a viewing audience.

2. Description of the Prior Art

Motion pictures are created by a series of photographs taken rapidly in sequence and arranged on a length of film. The film is wound on a motion picture reel and fed through a motion picture projector at a predetermined speed that is rapid enough to produce the illusion of actual movement of the figures in the sequence of photographs as the photographs are projected on the screen. The film is wound on the motion picture reel in a helical fashion about a hub that is fixed between a pair of much larger, narrow, planar retaining members. As film is advanced through the projector it is pulled off of one reel, advanced through the projector, and wound on a take-up reel. At the conclusion of presentation of the motion picture, the film is rewound back onto the original reel from which it was drawn during the presentation process.

In the motion picture industry, motion pictures are timed for release at a great number of locations during and immediately following very expensive promotional advertising campaigns. To maximize the number of viewers in the audiences, a great number of copies of a motion picture are created and are then distributed concurrently to numerous different movie theaters at the height of interest created by the advertising campaign. This distribution technique necessitates the creation of a great number of copies of each motion picture at the time of distribution. Each copy requires a separate, dedicated motion picture film reel.

During and immediately following the period of advertising promotion, a motion picture is widely exhibited at many different locations at the same time. Following the promotional period, however, the multitude of copies of the motion picture film produced and previously required are no longer necessary, and indeed, present problems.

It is highly desirable for excess copies of motion picture films to be destroyed rather than stored. Films to be stored for later use must be maintained under hermetically sealed conditions so as to avoid degradation of the film copy. While certainly a limited number of copies of the film are preserved for possible recirculation and for use as masters for the possible reproduction of additional copies at a future time, the great majority of the copies of motion pictures produced are destroyed following a limited period of wide-spread exhibition in movie theaters.

There are several reasons for destroying the many copies of a motion picture film that are no longer required after the initial period following release of the film. The expense of storing the very large number of copies which were once necessary in order to exhibit the motion picture at a multitude of different movie theaters cannot be justified. The cost of protection and storage of each copy of the motion picture film far outweighs the incremental cost of producing another motion picture copy should another copy be required. Moreover, when copies of motion picture films are stored they must be safeguarded against pilferage or other misappropriation. As a consequence, destruction of the excess number of copies of a motion picture film following release and circulation is a highly desirable alternative to storage.

Originally, motion picture film reels were made of metal. At the time of destruction the motion picture film was drawn off of such a reel and cut into small, unusable pieces for disposal. However, this was a very time consuming, and therefore expensive process.

Because of the lengthy time required to unwind a copy of a motion picture film for destruction, quicker destruction methods were devised. One method was to construct the reel upon which the film was wound of a plastic material that could be broken in order to retrieve the film for destruction without unwinding it when the copy of the film became redundant. As a consequence, the film did not have to be pulled lengthwise off of the reel by rotating the reel for a lengthy period of time, but instead could be pulled transversely off of the hub and destroyed without unwinding it.

However, since the film reel had to be made strong enough to withstand repeated transport and use and reuse during exhibition of the motion picture, the reel had to be constructed in a reasonably sturdy manner. As a result, smashing of the reel was laborious and also at times difficult. Moreover, the cost of replacing these reels for use with other motion picture films was considerable.

More recently, motion picture reels have been produced which are formed of component members that are releaseably attached to each other. Each of these conventional members is formed of a pair of broad cheek-plate portions and a central hub which can be releaseably fastened together. Originally the two component portions of the reel were screwed together. When the copy of the motion picture film wound thereon was no longer desired, the components of the reel were unscrewed from each other to provide complete access to the film wound on the central hub. However, the parts of this type of reel could accidentally become unscrewed during the time the film was in distribution.

A further type of motion picture film reel is now being produced in which the two halves of the motion picture reel included interlocking fingers at the hub that flex resiliently to interlock with a corresponding structure projecting from the other half of the reel. These two retaining members each include a metal insert into which a key is inserted. When the key is rotated, the fingers are deflected from engagement with the other portion of the reel, so that the two reel portions can be pulled apart. Each of the reel halves also includes either portions of an integrally formed hub portion upon which the film is wound or a hub insert. In either case a key is necessary to work within the metal insert so as to detach the reel halves from each other.

Furthermore, with this conventional design the metal insert becomes a problem in ultimately disposing of such reels once they have outlived their useful lives. The metal insert cannot be readily separated from the plastic. Therefore, recycling of the plastic portion of the reel, which represents by far the greater portion of the structure of the reel, becomes very difficult since the metal insert must first be removed.

A significant advance in the construction of motion picture film reels was achieved in U.S. Pat. No. 5,676,332, which is hereby incorporated by reference in its entirety. That patent describes a completely recyclable motion picture film reel, formed completely of plastic and having component parts that are releaseably attached together. In the structure of the device of this prior patent a pair of side retainers each formed of a generally flat, planar member are provided with a pair of resilient prongs defining catches thereon. These prongs are diametrically opposed to each other and extend from the inner face of the side retainers through the hollow core of a hub so that the catches at the ends of the prongs releaseably engage the far side of the hub. The prongs of each of the side retainers are angularly displaced ninety degrees from the prongs of each other side retainer and pass through channels defined in the base of the other side retainer so that the side retainers are immobilized relative to each other as well as relative to the hub.

The motion picture film reel of U.S. Pat. No. 5,676,332 is quite suitable for smaller reels, such as those in which the flat, planar members of the side retainers have a diameter of about fourteen and one-half inches. In larger reels, however, the torque applied in engaging the prongs sometimes breaks the prongs because they are so long.

To remedy this situation a different construction was devised and patented in prior U.S. Pat. No. 5,775,634, which is also hereby incorporated by reference in its entirety. In this system the film reel is comprised of a pair of side retainers that are releaseably engaged with a disk-shaped hub. Each of the side retainers has a pair of posts with catches on the ends thereof which may be inserted through post receiving apertures in a transverse web in the hub. The posts are also provided with cam surfaces which interact with each other to hold the catches engaged with the web. A latching mechanism immobilizes the side retainers relative to each other and relative to the hub until or unless released. However, this system can be utilized with a hub having only a single specific type of construction that provides holes of the precise size needed and at the specific locations required in the web of the hub.

SUMMARY OF THE INVENTION

The present invention provides a system that incorporates the advantages of both prior U.S. Pat. Nos. 5,676,332 and 5,775,634, but which avoids the disadvantages of those patents previously set forth. Specifically, the system of the present invention involves a construction in which a single prong on each side retainer is employed that extends from a core on the side retainer that fits into the tubular sleeve forming the inner circumference of the hub. Thus, the coupling system operates through the center of the hub and is not dependent upon any particular web configuration in the construction of the hub. The prongs do not have to extend all the way through the entire thickness of the hub because they are each mounted upon a core having a sturdy body that extends a substantial distance into the tubular sleeve of the hub. Each core should extend at least a third of the way through the tubular sleeve of the hub, but no greater than half way through. The use of a projecting core allows the length of the prong to be reduced considerably. Moreover, since there is a corresponding core extending into the tubular sleeve of the hub from the other side, the tip of the prong can be engaged in a mating cavity or socket defined in the other core. The prong and socket on each core are located diametrically opposite each other.

Furthermore, since the two side retainers are disposed in face-to-face relationship with the hub interposed therebetween, the side retainers can be of identical construction. This allows a single pair of identical side retainers to be employed in a motion picture reel, rather than requiring matching side retainers that have a unique, complementary construction.

In one broad aspect the present invention may be defined as a motion picture reel comprised of separable components including: a hub and a pair of side retainers. The hub has an outer ring with a peripheral cylindrical outer surface and also a hollow, cylindrical tubular sleeve located coaxially therewithin. Each of the side retainers has a hub engaging portion with inner and outer surfaces and defines a retainer axis of rotation. A releaseable hub latching member is formed on each hub engaging portion. Each side retainer also has a central core portion located on the inner surface of the hub engaging portion. The central core includes a prong projecting away from the inner surface and terminating in a hooked tip. A prong receiving socket is also formed in the core and defines a bearing ledge facing the inner surface of the hub engaging portion of the side retainer. The prong and the socket on each core are located in diametrical opposition from each other and at a common radial distance from the retainer axis of rotation.

The side retainers are positionable on opposing sides of the hub with the retainer axes of rotation and the hub all residing in coaxial alignment and with the cores of the side retainers projecting into the tubular sleeve of the hub but from opposite sides thereof. The hub latching members of the side retainers engage the hub so that the hub holds the side retainers a spaced distance apart from each other. The hooked tips of the prongs engage the sockets unless the hub latching members are released.

In another broad aspect the invention may be considered to be a motion picture reel having an axis of rotation and formed of separable and releaseably engageable components, including a pair of laterally confining retaining members and a disk-shaped annular hub. Each retaining member has a circular outer perimeter and a central retainer axis of rotation. Each retaining member includes a hub engaging portion having an inner and an outer surface.

A releaseable hub engaging latch is located on the inner surface of each hub engaging portion of each retaining member at a first spaced radial distance from the axis of rotation. Each laterally confining retaining member has a core centered on the retainer axis and projecting from the core in a direction perpendicular to the inner surface. Each of the cores includes a prong located at a second spaced radial distance from the retainer axis. Each prong terminates in a hook. Each of the cores further includes a prong receiving cavity with a bearing ledge facing the hub engaging portion of the retaining member. The prong receiving cavity is located diametrically opposite the prong and at the same second spaced radial distance from the axis of rotation as the prong.

The disk-shaped annular hub is formed with a peripheral rim and central, tubular sleeve. The hub is engageable between the lateral confining retaining members when they are oriented with their inner surfaces facing each other. The retainer axes of rotation and the hub axis of rotation are in mutually coaxial alignment. When the cores of the retaining members are inserted into the tubular sleeve of the hub from opposite directions, the hooks of the prongs engage the bearing ledges, and the hub engaging latches engage the hub to prevent disengagement of the hooks from the bearing ledges unless the hub engaging latches are released.

The hub is preferably comprised of at least one, and more typically a plurality, of radial spokes extending between the outer ring and the tubular sleeve and across a spaced distance between the side retainers. Each of the hub latching members on each of the side retainers is movable between a latching position projecting from the inner surface of the hub engaging portion inwardly toward the hub. In this latching position the hub latching members block rotation of the spoke or spokes. Each of the hub latching members is alternatively movable outwardly from the hub to a withdrawn, disengaged position resiliently deflected outwardly from the outer surface of the side retainer on which it is formed. This permits the film retaining members to be rotated slightly relative to each other so that the hooks are disengaged from the bearing ledges.

The invention may be described with greater clarity and particularity by reference to the accompanying drawings.

DESCRIPTION OF THE EMBODIMENT

Figure 1:
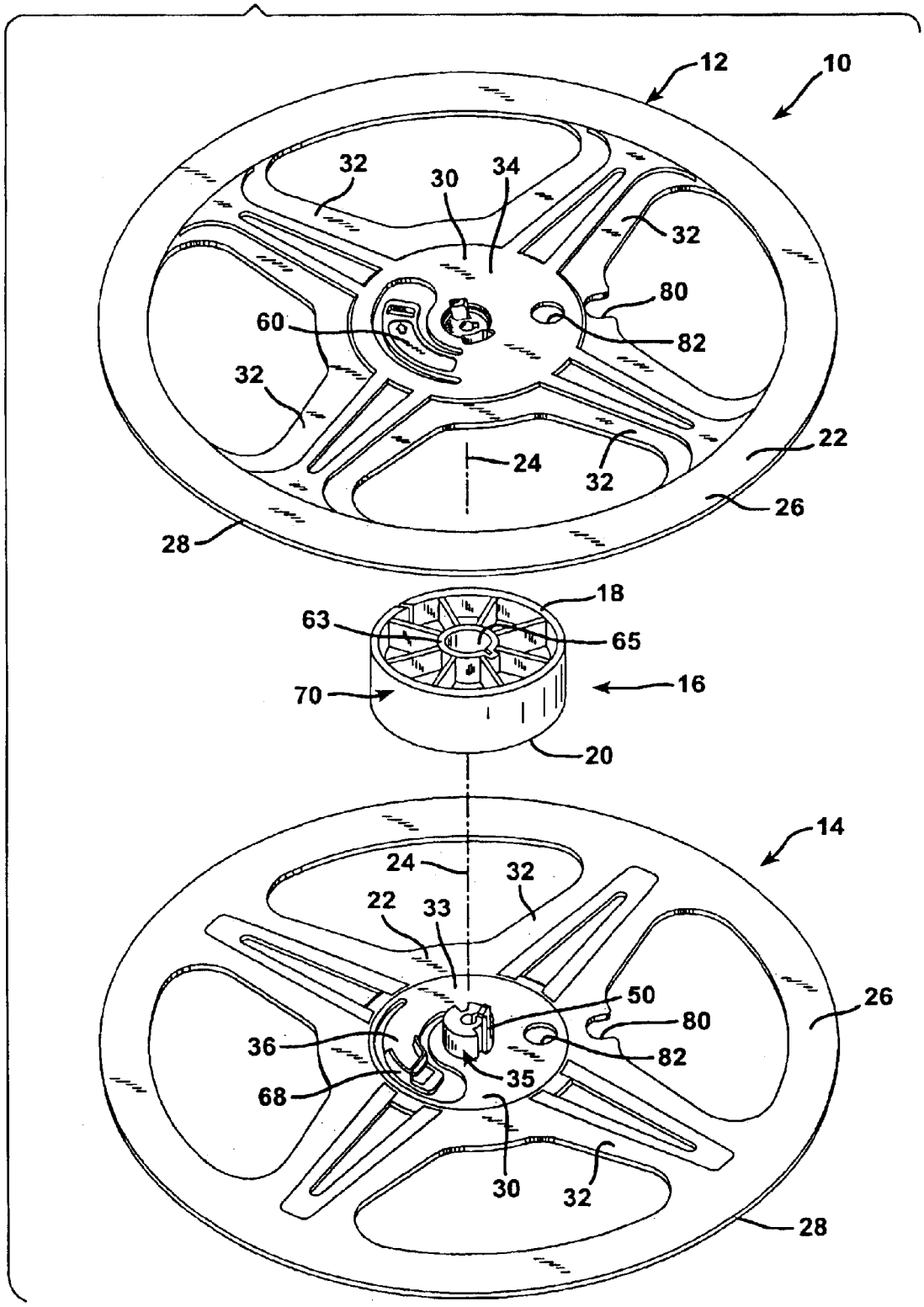
FIG. 1 is an exploded perspective view illustrating a preferred embodiment of the motion picture reel of the invention.
Figure 2:
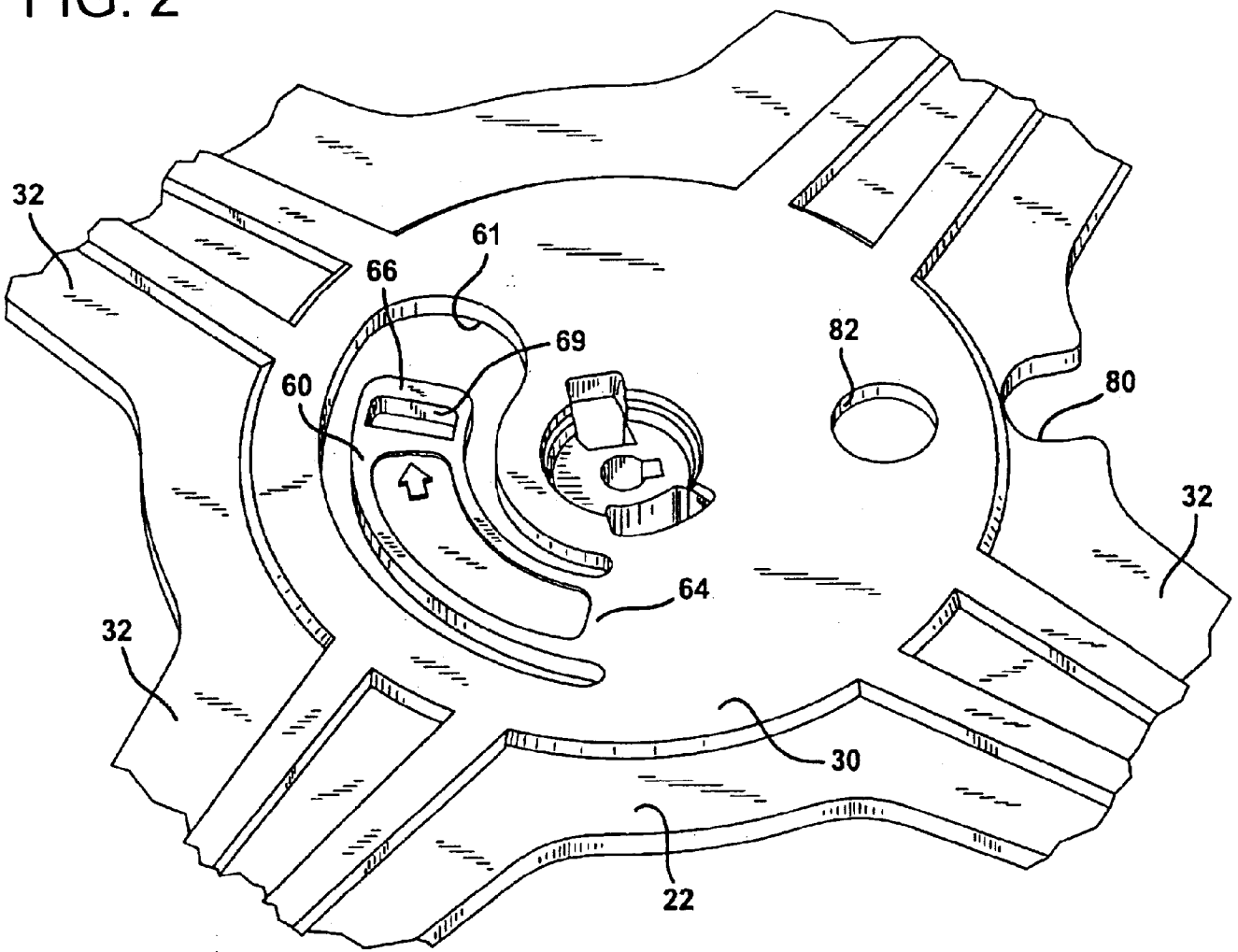
FIG. 2 is an enlarged, perspective detail illustrating the hub engaging portion of the outer surface of one of the side retainers of the motion picture reel illustrated in FIG. 1.
Figure 4:
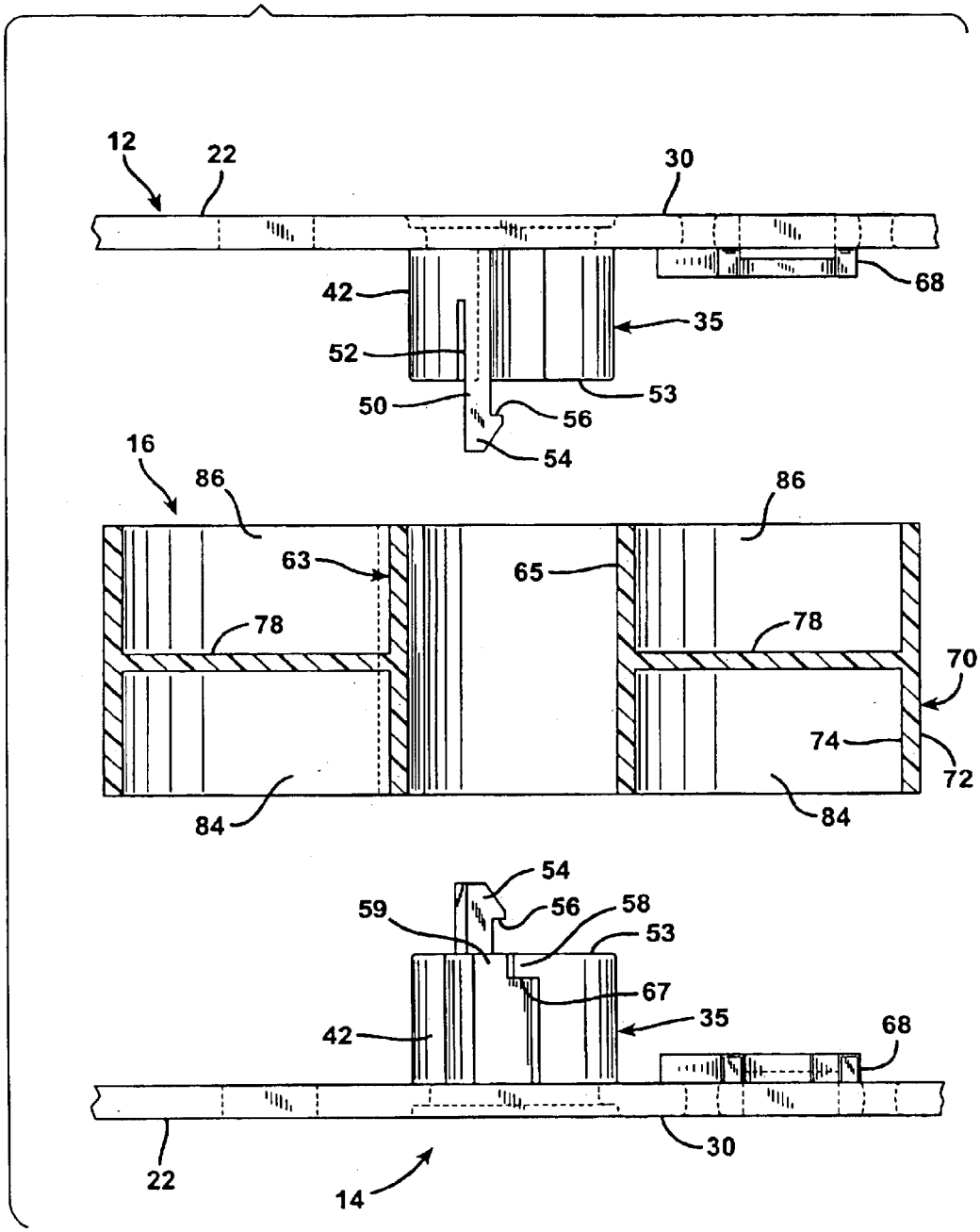
FIG. 4 is an exploded, elevational view of the central regions of the components of the motion picture reel of FIG. 1, with the hub shown in cross section.
Figure 5:
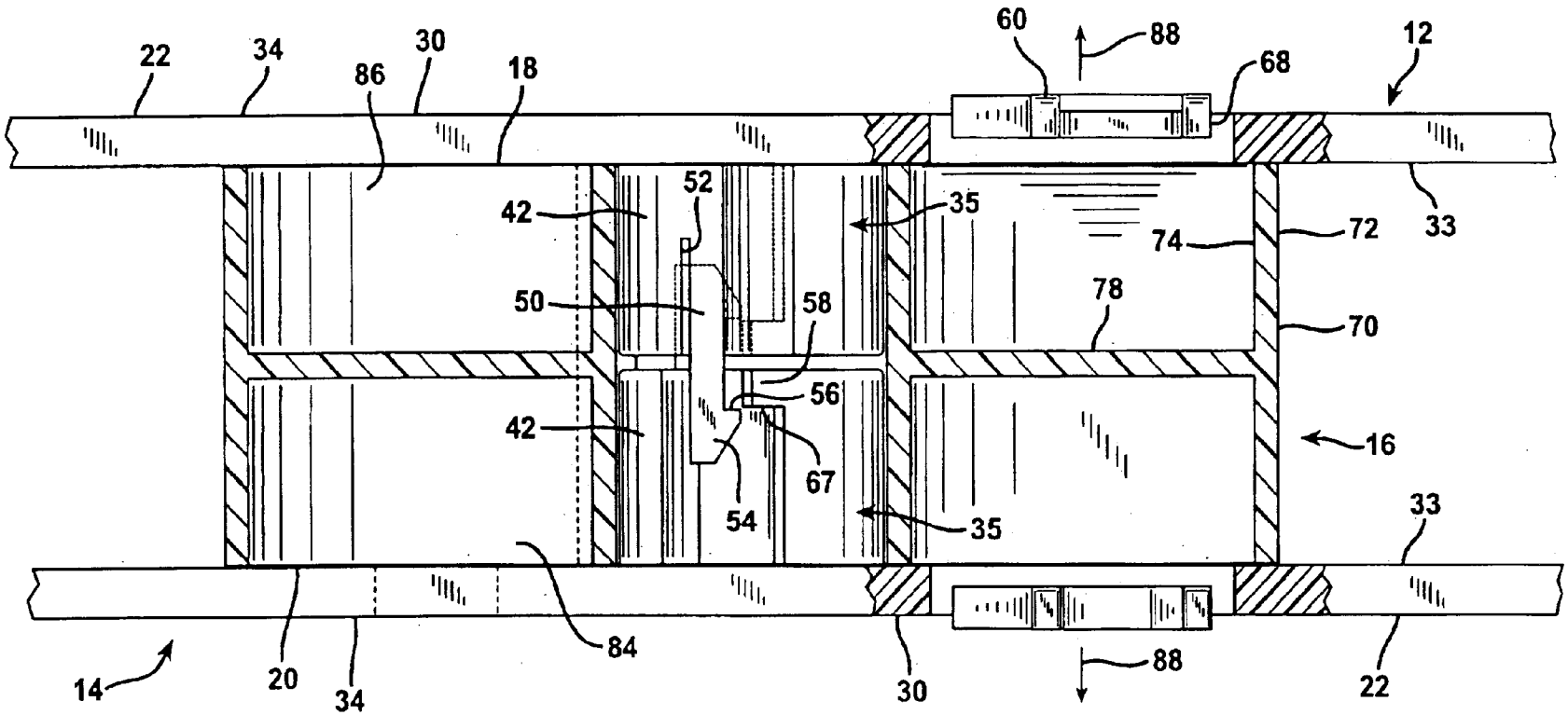
FIG. 5 is an elevational view of the regions of the components shown in FIG. 4 during a preliminary stage of assembly.
Figure 6:
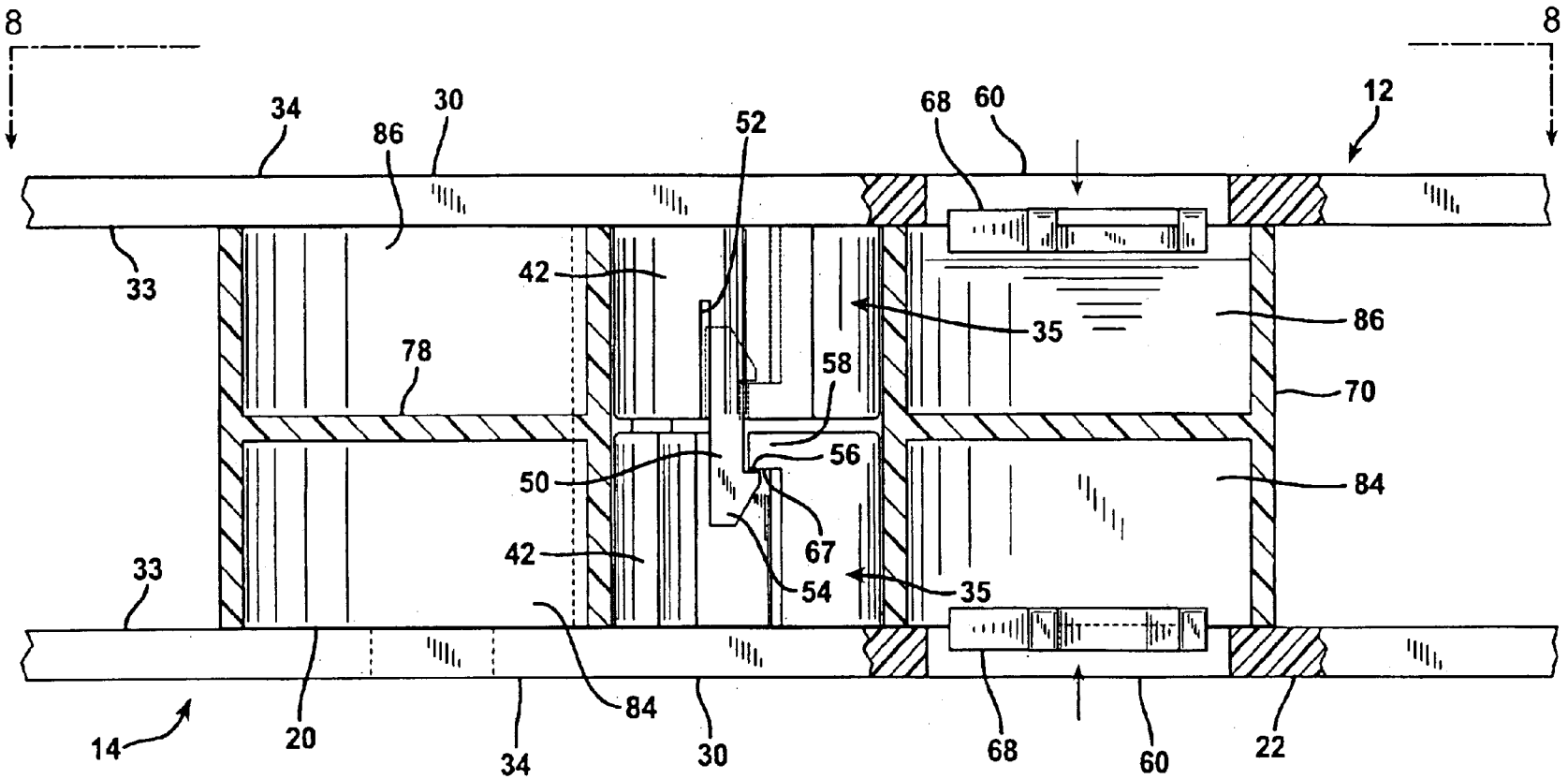
FIG. 6 is an elevational view of the regions of the components shown in FIG. 5 fully latched together.

FIG. 1 illustrates a motion picture film reel indicated generally at 10, comprised of separate components that are releaseably engageable together. These components include a pair of side retainers 12 and 14, and a disk-shaped hub 16 that is located therebetween when the components of the motion picture reel 10 are assembled together. The hub 16 has opposite sides 18 and 20. The distance between the sides 18 and 20 defines the height of the hub 16, which is uniform, as illustrated in FIG. 4. The uniform height of the hub 16 defines a uniform spaced distance of separation between the retaining members 12 and 14 when the hub 16 is positioned therebetween, as illustrated in FIGS. 5 and 6. All of the component members 12, 14, and 16 of the motion picture film reel 10 are formed of acronitrile-butadyene-styrene (ABS).

The retaining members 12 and 14 are identical to each other in construction. Each of the retaining members 12 and 14 is formed with a flat, side retainer or cheek-plate member 22. Each of the cheek-plate members 22 defines a peripheral region 26 with an outer, circular perimeter 28 defining a central retainer axis of rotation 24 and a central, hub engaging portion 30. The peripheral region 26 is joined to the hub engaging portion 30 by four substantially flat spokes 32 reinforced with radial ribs and located at ninety degree intervals about each of the retaining members 12 and 14. The spokes 32 radiate from the hub engaging portion 30 to meet the retaining member peripheral region 26. The circular perimeter 28 of the peripheral region 26 concentrically surrounds the hub engaging portion 30.

Each of the hub engaging portions 30 of the flat, cheek-plate members 22 has an inner surface 33 and an outer surface 34. The outer surface 34 of the side retaining member 12 and the inner surface 33 of the side retaining member 14 are visible in FIG. 1.

Each hub engaging portion 30 is centered within the perimeter 28 and includes an inner core 35 which is a generally disk-shaped structure having a generally cylindrical body 42. Each hub engaging portion 30 also includes a releaseable hub latching member which is a resilient finger 60. The resilient finger 60 is located at a first spaced radial distance from the axis of rotation 24, within the hub engaging portion 30.

A pair of diametrically opposed, generally sector-shaped notches 37 and 39 are defined radially into the otherwise cylindrical outer surface of the body 42 of the core 35. The height of the core body 42, as measured by the distance from the inner surface 33 to the top 53 of the core body 42, is no greater than one-half the distance between the surfaces 18 and 20 of the hub 16, and no less than about one-third of that distance. The height of the core body 42 is preferably one-half that distance, or slightly less.

Figure 3:
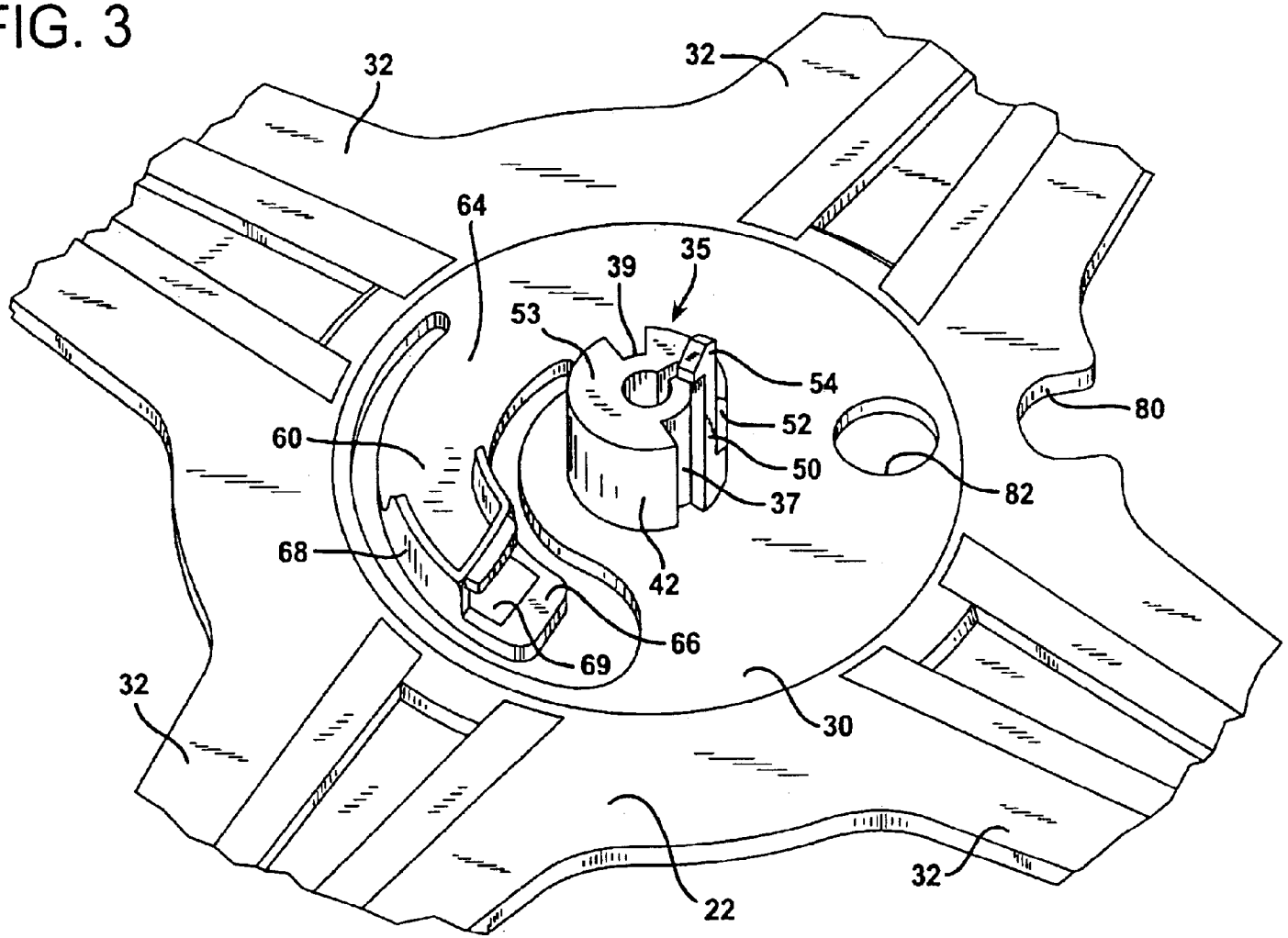
FIG. 3 is an enlarged, perspective detail illustrating the hub engaging portion of the inner surface of one of the side retainers of the motion picture reel illustrated in FIG. 1.

Immediately adjacent the notch 37 a prong 50 is formed partially by a radial slit 52 defined into the structure of the core 35. The prong 50 projects beyond the top 53 of the core body 42 perpendicular to the cheek-plate member 22. The slit 52 is preferably about three-quarters of an inch in length and the prong 50 extends beyond the flat top 53 of the core 35 a distance of about three-quarters of an inch. The prong 50 has a tip that terminates in a hook 54. The hook 54 has a flat planar face 56 that faces and is parallel to the top 53 of the core 35 and to the inner surface 33 of the cheek-plate 22. The prongs 50 on the retainer members 12 and 14 of the motion picture reel 10 are best illustrated in FIGS. 3 and 4.

Diametrically opposite each prong 50 on each core 35 there is a prong receiving cavity formed by the notch 39. The notch 39 is formed with an overhanging bearing ledge 58. There is a narrow gap 59 at the top of the notch 39 adjacent the overhanging bearing ledge 58, which creates an undercut and defines a flat bearing face 67 that is parallel to and faces the inner surface 33 of the hub engaging portion 30 from which the core 35 formed on that cheek-plate projects. The notch 39 is thereby configured as a prong receiving cavity that serves as a socket for the prong 50.

As best illustrated in the lower portion of FIG. 4, the hook 54 and the bearing ledge 58 of each core 35 are directed in the same angular direction relative to the core 35 upon which they are formed. The bearing ledge 58 and the hook 54 are also located at the same radial distance from the central axis of rotation 24, which is a second radial distance smaller than the radial distance at which the resilient hub latching fingers 60 are located. The hooks 54 thereby project in a tangential direction relative to the retainer axis of rotation 24. The bearing ledges 58 also lie in a tangential direction relative to the retainer axis of rotation 24.

The resilient, arcuate finger 60 forms a hub latching mechanism that is engageable with the hub 16. The resilient finger 60 extends over a circular arc of roughly about one hundred ten degrees centered on the retainer axis, which is the axis of rotation 24. The hub latching finger 60 is formed from the structure of the cheek-plate member 22 within the hub engaging portion 30 thereof. Together, the hub latching fingers 60 on the retaining members 12 and 14 serve to immobilize each of the retaining cheek-plate members 22 relative to the hub 16, and to prevent relevant movement therebetween when they are engaged.

Figure 9:
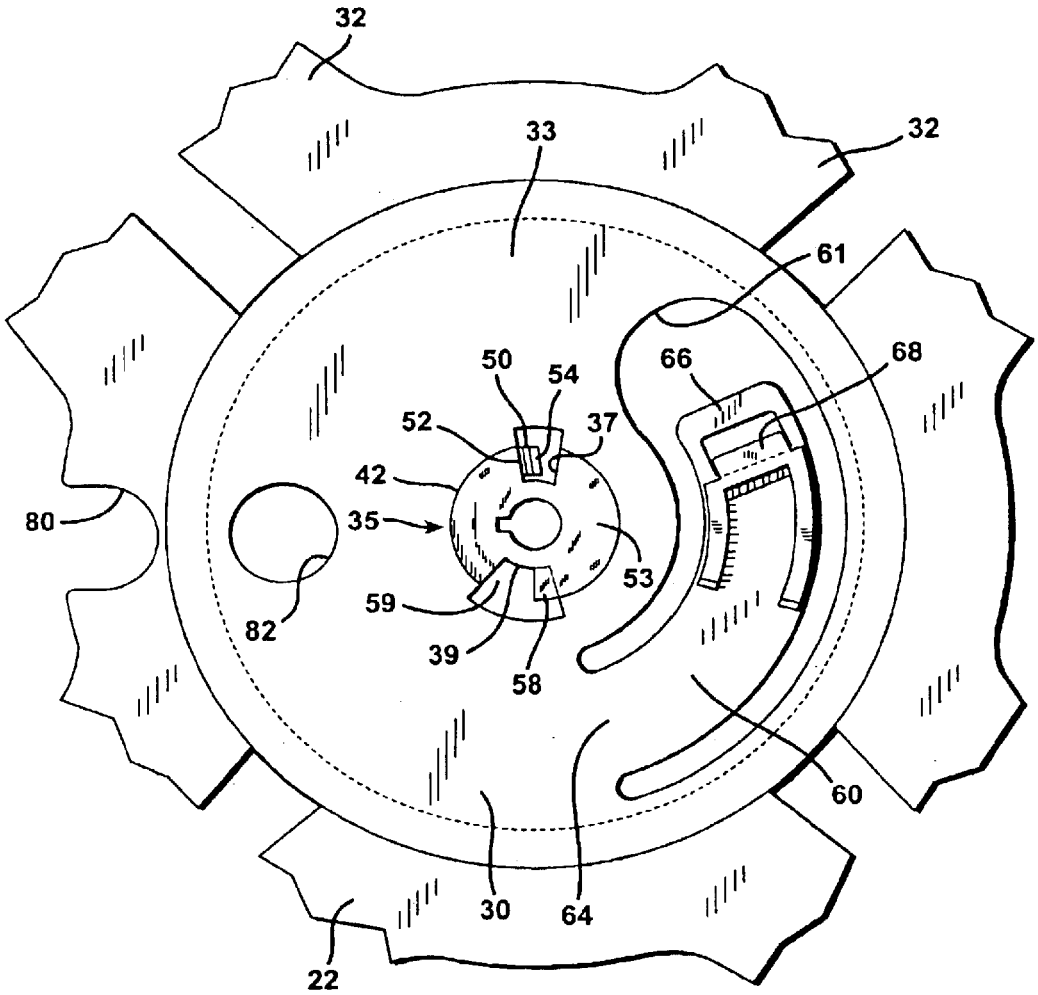
FIG. 9 is a bottom plan detail illustrating the hub engaging portion of the inner surface of one of the side retainers of the motion picture reel illustrated in FIG. 1.

Each of the hub latching fingers 60 is comprised of an arcuate portion of the hub engaging portion 30 of the cheek-plate 22 integrally formed from the same structure forming the retaining cheek-plate member 22. Each latching finger 60 has a first end 64 which is securely anchored to the structure of the retaining cheek-plate member 22 from which it is formed. The first, anchored end 64 of each latching finger 60 is fastened to the inner hub engaging portion 30 so that the free end 66 of the latching finger 60 is resiliently flexible with respect to the flat, retaining, cheek-plate member 22. At its free, resiliently deflectable end 66, each latching finger 60 carries a blocking lug member 68. As shown in FIG. 9, the blocking lug 68 is formed as a generally U-shaped lug that normally projects out of the plane of the inner surface 33 of the hub engaging portion 30 of each retaining member 12 and 14 a distance of about one-half of an inch when the resilient finger 60 is in its undeflected position residing largely within the plane of the check-plate 22. The open end of the U-shaped blocking lug member 68 faces the anchored or fixed end 64 of the resilient finger 60.

Figure 8:
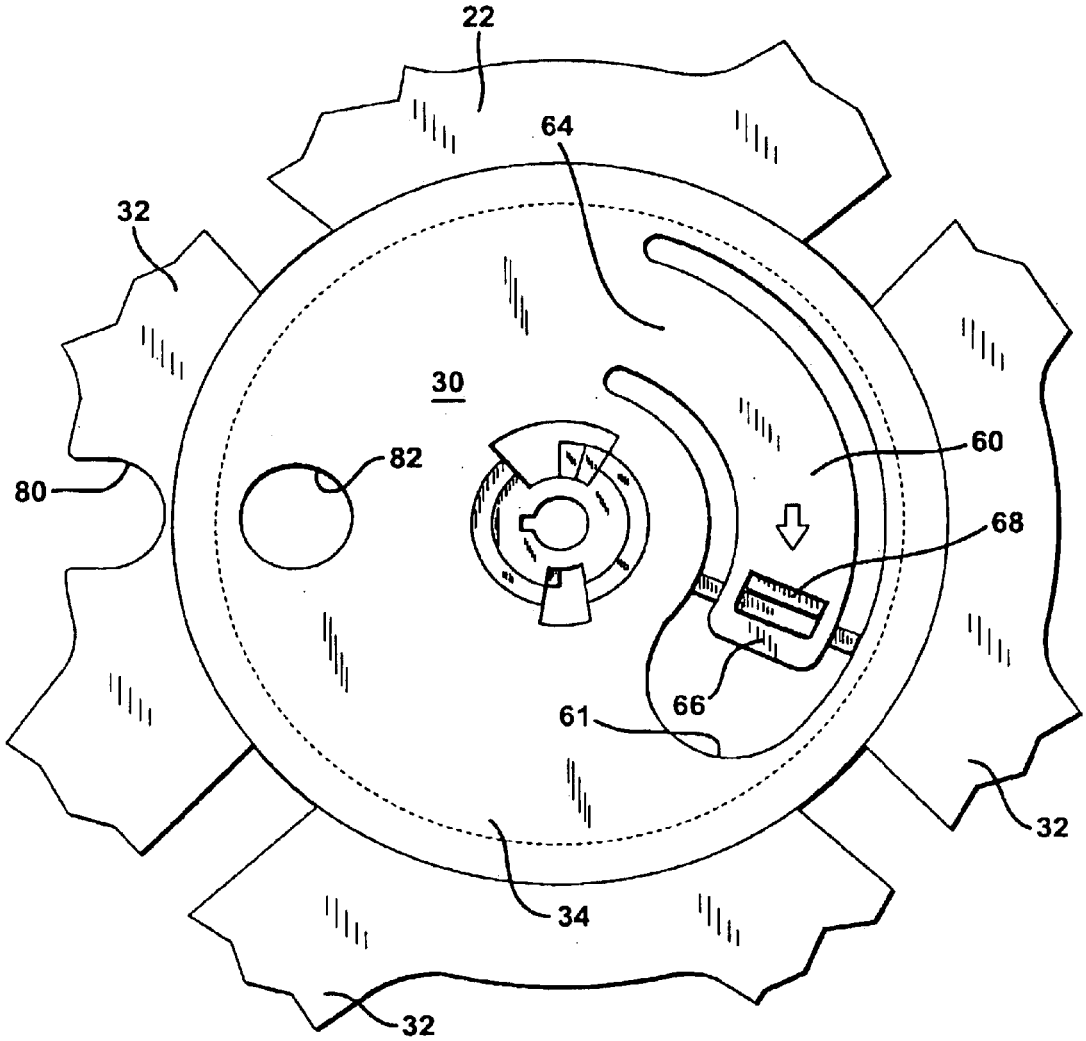
FIG. 8 is a top plan detail taken along the lines 8—8 of FIG. 6.

Each of the latching finger members 60 is formed within a latching element opening 61 in each of the cheek-plate members 22, as best depicted in FIGS. 3, 8, and 9. The opening 61 is narrow along the sides of the latching finger 60, but is rounded and extends a long enough distance beyond the free end 66 thereof so that a person's finger can be inserted through it to lift the free end 66 of the resilient finger 60 from beneath. Near its extremity the free end 66 of the latching finger 60 forms a narrow aperture 69 that is formed through the structure of the resilient finger 60 just beyond the blocking member 68.

Figure 7:
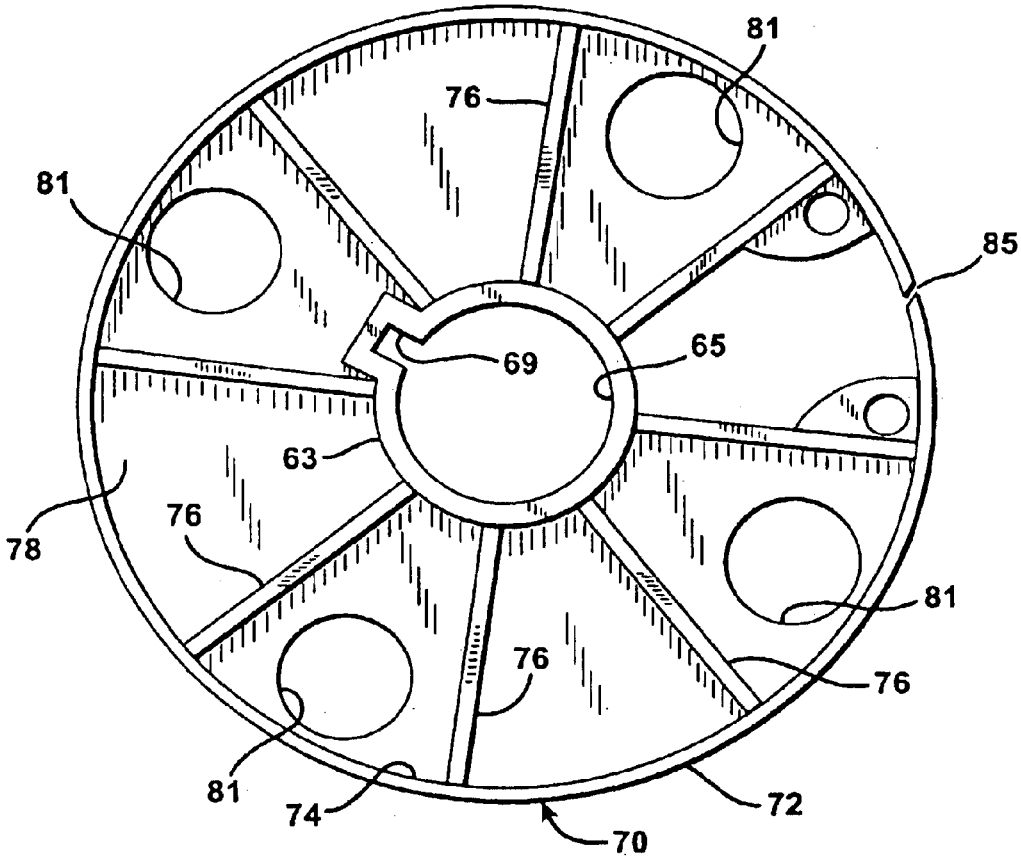
FIG. 7 is a top plan view of the hub of the motion picture reel of FIG. 1 shown in isolation.

The hub 16 is formed with a central, generally cylindrical annular tubular sleeve 63 through which a central, axial opening 65 is defined as best depicted in FIGS. 1 and 7. The hub 16 also includes an annular ring-shaped hub ring or rim 70 having a cylindrical outer surface 72 and a cylindrical inner surface 74. The cylindrical outer surface 72 has a diameter of four inches and the axial, circular opening 65 in the tubular sleeve is one inch in diameter. These are standard specifications for motion picture film reels in the motion picture industry. The rim 70 is set radially outwardly from the tubular sleeve 63 and is joined thereto by eight radial spokes 76 formed as flat partitions that extend between the inner surface 74 of the hub rim 70 and the outer surface of the tubular sleeve 63. The radial spokes 76 divide the area between the tubular sleeve 63 and the rim 70 into sectors.

The hub 16 is also constructed with a flat web 78 that is oriented perpendicular to the axis of the hub 16, and bisects the hub 16 into two identical portions, one on either side of the web 78. The web 78 extends radially outwardly from the cylindrical tubular sleeve 63 to the cylindrical inner surface 74 of the annular hub rim 70 throughout all but one of the sectors of the annular area therebetween, and is formed with two pairs of circular apertures 81 therethrough located diametrically opposite each other and ninety degrees apart.

The radial spokes 76 extend axially in opposite directions from the web 78 to form panels 84 extending toward the side 20 of the hub 16 and panels 86 extending toward the side 18 of the hub 16. The hub engaging fingers 60 of the retainers 12 and 14 are engageable with selected ones of the panels 84 and 86 when the retaining members 12 and 14 are assembled with hub 16. The panels 84 and 86 extend radially inwardly from the outer cylindrical rim 70 of the hub 16 on both axial sides of the web 78. As best illustrated in FIG. 4, the width of the hub 16 is uniform throughout and is equal to the length of the tubular sleeve 63 and the length of the cylindrical outer rim 70.

Each of the cheek-plate members 22 is formed with an outwardly directed radial notch 80 in the periphery of its hub engaging portion 30 and with a circular aperture 82 located radially inwardly therefrom, through the structure of the hub engaging portion 30. The notches 80 and apertures 82 are provided to facilitate a film projector operator in manipulating the end of the length of film into the film receiving slot 85 defined in the peripheral cylindrical annular rim 70 of the hub 16. The notches 80 and apertures 82 also serve as visual locators for properly aligning the film retainers 12 and 14 relative to each other in preparation for coupling the retainers 12 and 14 together with the hub 16 interposed therebetween.

To assemble the component elements of the motion picture reel 10 together, the retainers 12 and 14 are positioned in face-to-face relationship, with their inner surfaces 33 of the hub engaging portions 30 facing each other and with the hub 16 located therebetween, as illustrated in FIG. 1. The notches 80 and apertures 82 should be nearly aligned with each other, but initially angularly offset from each other by a predetermined arcuate angular range. Preferably, this angular range is about three degrees.

Once this slightly offset alignment is achieved, the cores 35 of both of the cheek-plate members 22 of the two retainers 12 and 14 are coaxially aligned with each other and with the common axis of rotation 24 of the tubular sleeve 63 of the hub 16, as illustrated in FIG. 4. As shown in that drawing figure the height of the body 42 of each core 35 is no greater than half the height of the tubular sleeve 63 of the hub 16, and preferably is exactly half of the height of the tubular sleeve 63. The outer diameter of the body portion 42 of each core 35 closely approaches that of the inner diameter of the tubular sleeve 63, so that the bodies 42 of the cores 35 both fit smoothly into the tubular sleeve 63 of the hub 16 and reside in contact therewith.

With the notches 80 and openings 82 in slightly offset alignment from each other as previously described, the retainers 12 and 14 are advanced toward each other so that the cores 35 of the cheek-plates 22 enter the tubular sleeve 63 from opposite directions. As the prongs 50 approach the core 35 of the other retainer, the prongs 50 are aligned with the gaps 59 defined adjacent to the overhanging bearing ledges 58 of the notches 39, as illustrated in FIG. 4.

As shown in FIG. 5, the prongs 50 simultaneously enter the gaps 59 defined in the notches 39 of the two cores 35. The retainers 12 and 14 are then counterrotated relative to each other slightly, preferably by only about three degrees. This slight counterrotation brings the bearing faces 56 of the hooks 54 into contact and mutually abutting, facing relationship with each other, as illustrated in FIG. 6.

As the retainers 12 and 14 approach each other as illustrated in FIG. 4, the lugs 68 initially reside directly atop one of the panels 84 or 86 of the spokes 76 of the hub 16. That is, the lug 68 of the retainer 12 initially resides directly atop one of the panels 86 of the hub 16, while the lug 68 of the retainer 14 resides directly atop one of the panels 84 of the hub 16. Since the presence of the spoke panels 84 and 86 prevents further advancement of the lugs 68 toward each other, the free ends 66 of the resilient fingers 36 are deflected outwardly from the outer surfaces 32 of the retainers 12 and 14, out of the plane of the cheek-plates 22, as indicated by the directional arrows 88 and FIG. 5.

However, once the retainers 12 and 14 have been counterrotated slightly relative to each other so as to bring the notches 80 of the cheek plates 22 into coaxial alignment with each other and the hooks 54 into face-to-face abutment with the undercut surfaces 67 of the bearing ledges 58, the lugs 68 are concurrently rotated out of direct alignment with the panels 84 and 86 of the spokes 76. As a consequence, the elastic deformation of the resilient lug latching fingers 60 causes the lugs 68 to spring back to their undeflected positions so that the fingers 60 reside within the planes of the cheek-plate members 22, and the lugs 68 are thereupon brought into abutting relationship relative to the spoke panels 84 and 86 immediately adjacent thereto.

The lug latching fingers 60 then prevent any relative rotation between the retainers 12 and 14 as long as they remain in an undeflected condition. The retainers 12 and 14 cannot be rotated back to the position of FIG. 5 from the position of FIG. 6 until or unless the free ends 66 of the lug latching fingers 60 are lifted by inserting fingertips through the large open areas at the ends of the finger defining openings 61 and purposefully lifting the free ends 66 of the resilient fingers 60 in the direction indicated by the directional arrows 88 in FIG. 5. Only then can the retainers 12 and 14 be rotated back to the positions illustrated in FIG. 5.

On the other hand, with the lugs 68 engaged in abutting relationship relative to the panels 84 and 86 of the spokes 72, the retainers 12 and 14 cannot be rotated relative to each other in the opposite direction from the positions shown in FIG. 6. This is because the overhang ledges 58 and the portions of the prongs 50 immediately beneath the hooks 54 create an interference that prevents such rotation.

By forming the prongs 50 from core structures 35 having sturdy bodies 42 and by configuring the cores 35 so that they enter and meet or nearly meet within the confines of the tubular sleeve 63 of the hub 16, the unsupported projecting distal portions of the prongs 50 that extend beyond the tops 53 of the cores 35 can be reduced to a minimum. This greatly reduces the vulnerability of the prongs 50 to breaking.

Moreover, by providing a structure in which the side retainers 12 and 14 can be latched directly together by mechanisms within the tubular sleeve 63 of the hub 16, the use of the retainers 12 and 14 of the invention is not restricted to any of the various hub structures commercially available in the motion picture film reel industry. That is, some hubs that are employed in film reels do not include the apertures 81 and all portions of the web 78, and those that do sometimes have apertures of different sizes or at different locations. The present invention avoids any reliance on the web and spoke construction of the hubs 16 beyond the standardized inner and outer diameters thereof, and the standardized spoke placement that are utilized throughout the motion picture film industry.

Undoubtedly, numerous variations and modifications of the invention will become readily apparent to those familiar with motion picture reels. For example, the particular hook and lug arrangements illustrated in the preferred embodiment of the invention depicted can be modified with considerable variations. Accordingly, the scope of the invention should not be construed as limited to the specific embodiment depicted and described, but rather is defined in the claims appended hereto.

I claim:

1. A motion picture reel comprised of separable components including:

a hub having an outer ring with a peripheral, cylindrical outer surface and a hollow, cylindrical tubular sleeve located coaxially therewithin, and a pair of side retainers each having an axis of rotation and a flat hub engaging portion with inner and outer surfaces and a releaseable hub latching member formed thereon, and a central core portion located on said inner surface of said flat hub engaging portion, and said central core portion includes a prong projecting away from said inner surface and terminating in a hooked tip, and a prong receiving socket defining a bearing ledge facing said inner surface, and said prong and said socket are located in diametrical opposition from each other and at a radial distance from said retainer axis of rotation, whereby said side retainers are positionable on opposing sides of said hub with said side retainers and said hub all in coaxial alignment and with said core portions of said side retainers projecting into said tubular sleeve of said hub from opposing sides thereof, and said hub latching members of said side retainers engage said hub so that said hub holds said side retainers a spaced distance apart from each other and said hooked tips of said prongs engage in said sockets, unless said hub latching members are released.

2. A motion picture reel according to claim 1 wherein said core portions each include a body having a height equal to no greater than one-half the length of said tubular sleeve and with said prong projecting beyond said height of said body parallel to said retainer axis of rotation, and said body is formed with an outer diameter so that said body fits smoothly into said tubular sleeve of said hub and resides in contact therewith.

3. A motion picture reel according to claim 2 wherein said tips of said prongs define hooks that project in a tangential direction relative to said retainer axis of rotation, and said socket of each core is formed as a cavity in said body defining said bearing ledge within said body that also lies in a tangential direction relative to said retainer axis of rotation and facing said hub engaging portion upon which said core is formed, and said hook and said bearing ledge reside at the same radial distance from said retainer axis of rotation.

4. A motion picture film reel according to claim 2 wherein said hub includes a plurality of radial spokes joining said outer ring to said tubular sleeve, and said hub latching members are each formed as a resilient finger from the structure of said hub engaging portion extending over a circular arc centered on said retainer axis of rotation and having fixed and deflectable ends, and a lug is formed projecting from said inner surface of said hub engaging portion at said deflectable end of said finger, whereby said hub latching members of said side retainers are engageable with selected ones of said spokes when said side retainers are assembled with said hub.

5. A motion picture reel according to claim 4 wherein said lugs meet said selected ones of said spokes in abutting relationship therewith when said side retainers are assembled with said hub.

6. A motion picture reel according to claim 2 wherein said hub is comprised of at least one radial spoke extending between said outer ring and said tubular sleeve and across said spaced distance between said side retainers, and each of said hub latching members on each of said side retainers is movable between a latching position projecting from said inner surface of said hub engaging portion inwardly toward said hub thereby blocking rotation of said at least one spoke, and alternatively movable outwardly from said outer surface of said hub engaging portion to a withdrawn disengaged position.

7. A motion picture reel formed of separable and releaseably engageable components including:

a pair of laterally confining retaining members each having a circular perimeter and a central, retainer axis of rotation and each including a hub engaging portion having inner and outer surfaces with a releaseable hub engaging latch located on said inner surface at a first spaced radial distance from said retainer axis, and a core centered on said retainer axis and projecting in a direction perpendicular to said inner surface, and each of said cores includes a prong located at a second spaced radial distance from said retainer axis and oriented parallel thereto and terminating in a hook, and each of said cores further includes a prong receiving cavity with a bearing ledge facing said hub engaging portion of said retaining member and said prong receiving cavity is located diametrically opposite said prong and at the same second spaced radial distance from said retainer axis as said prong, and a disk-shaped annular hub formed with a peripheral rim and a central, tubular sleeve, and a uniform height throughout, and wherein said hub is engageable between said laterally confining retaining members when said laterally confining retaining members are oriented with said inner surfaces of said hub engaging portions facing each other and in mutually coaxial alignment with each other and with said hub, and said cores of said retaining members are inserted into said tubular sleeve of said hub from opposite directions so that said hooks of said prongs engage said bearing ledges and said hub engaging latches engage said hub to prevent disengagement of said hooks from said bearing ledges unless said hub engaging latches are released.

8. A motion picture reel according to claim 7 wherein both said bearing ledge and said hook are oriented tangentially in the same angular direction relative to send retainer axis at said second, spaced distance therefrom.

9. A motion picture reel according to claim 7 wherein said retaining members are engageable with each other with said hub disposed therebetween by advancement of said cores of said retaining members toward each other, whereby said prongs enter said prong receiving cavities and are engaged therewith by relative rotation between said retaining members and engagement of said latching member with said hub.

10. A motion picture reel according to claim 7 wherein each of said cores is formed with a body having a circular, arcuate periphery centered on said retainer axis and said body has a length no greater than half said height of said hub and no less than one-third said height of said hub.

11. A motion picture reel according to claim 7 wherein said hub engaging latches are comprised of resilient fingers having opposing attached free ends and are formed from the structure of said hub engaging portions of said retaining members, and further comprising lugs projecting from said free ends of said resilient fingers in a direction parallel to said prongs.

12. A motion picture reel according to claim 11 wherein said hub is equipped with a plurality of radial spokes extending between said peripheral rim and said tubular sleeve, and said fingers extend in a circular arc centered on said retainer axis.

13. A motion picture film reel comprising:

a pair of retaining members each formed with a side cheek-plate member having inner and outer surfaces, a central axis of rotation, an outer circular perimeter, and an inner core concentric relative to said central axis of rotation, and a resilient finger defined in said cheek-plate member and including a latching member thereon projecting from said inner cheek-plate surface in a direction normal to said cheek-plate, and said inner core is formed with an arcuate outer shape on said inner cheek-plate surface with a prong projecting therefrom away from said inner surface of said cheek-plate member and having a tip terminating in a hook, and diametrically opposite said prong, a prong receiving cavity having a bearing ledge is defined in said core, and said hook and said bearing ledge are directed in the same angular direction relative to said core, and at the same radial distance from said central axis of rotation, and a disk-shaped annular hub having a central, tubular sleeve, a plurality of spokes projecting radially from said sleeve, a ring-shaped peripheral rim held by said spokes to said central, tubular sleeve, and said retaining members are engageable with each other when oriented with their inner surfaces facing each other with said hub interposed therebetween and with said cores of said retaining members projecting within said tubular sleeve of said hub, and when said retaining members are twisted angularly relative to each other to bring said hooks on each prong of each retaining member to meet said bearing ledge of each other retaining member, and said hooks are thereupon held in contact with said bearing ledges by the thickness of said hub, while said latching members of said fingers reside in abutment against selected ones of said spokes to prevent relative rotation between said retaining members unless said fingers are deflected outwardly from said outer surfaces of said cheek-plate members to disengage said latching members from said spokes.

14. A motion picture reel according to claim 13 wherein said central, axial cores each have a disk-shaped configuration and said cores fit smoothly into said tubular sleeve of said hub from opposite sides thereof.

* * * * *